United States Patent [19]

Henderson et al.

[11] Patent Number: 4,893,116

[45] Date of Patent: Jan. 9, 1990

[54] LOGICAL DRAWING AND TRANSPARENCY CIRCUITS FOR BIT MAPPED VIDEO DISPLAY CONTROLLERS

[75] Inventors: David L. Henderson, Marlboro, Mass.; Brian K. Herbert, Colorado Springs; Michael D. Lahey, Colorado Springs; Jamey L. Robbins, Colorado Springs, all of Colo.

[73] Assignee: NCR Corporation, Dayton, Ohio

[21] Appl. No.: 120,902

[22] Filed: Nov. 16, 1987

[51] Int. Cl.[4] ..... G09G 1/14

[52] U.S. Cl. ..... 340/747; 364/521

[58] Field of Search ..... 340/747, 723, 703, 734, 340/724; 364/521

[56] References Cited

U.S. PATENT DOCUMENTS

| | | | |
|---|---|---|---|
| 4,682,297 | 7/1987 | Iwami | 340/734 |
| 4,700,181 | 10/1987 | Maine et al. | 340/724 |
| 4,752,893 | 6/1988 | Guttag et al. | 340/747 |

OTHER PUBLICATIONS

"NCR 7300/7301 Color Graphics Chip Set Preliminary Data Sheet", NCR Microelectronics Division, Colorado Springs, Revision May 1, 1986.

"NCR Color Graphics Controller", NCR 7300, NCR Microelectronics Division.

*Primary Examiner*—David K. Moore
*Assistant Examiner*—Richard Hjerpe
*Attorney, Agent, or Firm*—Wilbert Hawk, Jr.; Casimer K. Salys

[57] ABSTRACT

An interface controller, situated between a graphics controller and a memory array in a color video display system operable in a read-modify-write mode, configured to detect a select transparency color in whole or in part and to respond by selectively changing the color binary data for the corresponding pixel in a frame buffer. In another aspect, the invention includes drawing modes impelmented by logically combining pixel color binary data in accordance with a defined truth table so as to allow the pixel color data representing a new image to interact in a defined manner based upon color with the data in a previously defined image. As implemented, the binary data in the frame buffer is acted upon in a read-modify-write sequence whereby the various logic operations analyze the source (foreground) pixel data, the destination (background) pixel data, in the context of control signals, to define the pixel color data written into the frame buffer as the color representation for that pixel position.

8 Claims, 13 Drawing Sheets

ROM SEQUENCER AND CONTROL

TRANSPARENT COLOR REGISTERS

SERIAL/PARALLEL REGISTERS

LOGICAL DRAWING AND TRANSPARENCY CIRCUITS FOR BIT MAPPED VIDEO DISPLAY CONTROLLERS

BACKGROUND OF THE INVENTION

The present invention relates to the control of pixel colors in a video display system, and more particularly, the arrangement of electronic elements to implement transparency and drawing modes in contemporary graphic controllers of work stations or advanced personal computer systems.

Graphic control chips suitable to generate patterns for the color video displays used with computer systems exist in various forms. Specific examples which form the background of the present invention may be found in the NCR 7300 color graphics controller chip and its companion NCR 7301 memory interface controller chip. Information regarding the architecture and functional attributes of such controllers is broadly disseminated to those who routinely practice in the art using data sheets and application publications which promote the devices. Furthermore, with the diversity of graphic controller products on the market, numerous structural and functional aspects of such graphic controllers are common to broad cross-sections of the product lines.

The function of such graphic controllers is to translate relatively high level graphic commands from computer microprocessors into graphic chip machine level routines which control the colors of the individuals pixels appearing on the video display. The colors of the pixels on the video display are commonly defined by corresponding binary data stored in a frame buffer memory which is raster scanned in synchronism with the video display. The creation and alteration of the binary data in the frame buffer between raster scanning operations are the activities of the color graphics control system.

The invention at hand is directed to circuitry which performs two functions heretofore requiring elaborate software manipulations. One involves the provision of a transparency mode. The other is a logical drawing mode. The outcome of each mode is reflected in the binary data held by the frame buffer and visually discernible on the color video display.

SUMMARY OF THE INVENTION

In one aspect, the invention is directed to a circuit architecture for implementing a read-modify-write sequence in a pixel based color video graphics controller where there is provided a source of binary data representing foreground (new image) and background (previous image) pixel color data. The foreground data, stored in a source register, is processed through logic which defines by pixel, according to a truth table, the new background color. This new, logically defined background color is transmitted to the video display and stored in the frame buffer.

The invention, in another aspect, involves the architecture and functional circuits which read frame buffer pixel data representing color, compare such data by pixel with transparency colors to identify complete or partial matches, and respond according to a defined logic sequence upon identifying a correspondence. The circuit architecture provides a direct hardware implementation for comparing a new image, source color, for both an identical or a partial match to the transparency color. The selective match is implemented by disabling, in a "don't car" sense, individual bits from the transparency color word during the comparison.

The architecture of the invention is clock synchronized and operable with reference to the frame buffer at a frequency compatible with the video displays of high resolution computer system video displays.

DESCRIPTION OF THE PREFERRED EMBODIMENT

Figure 1:
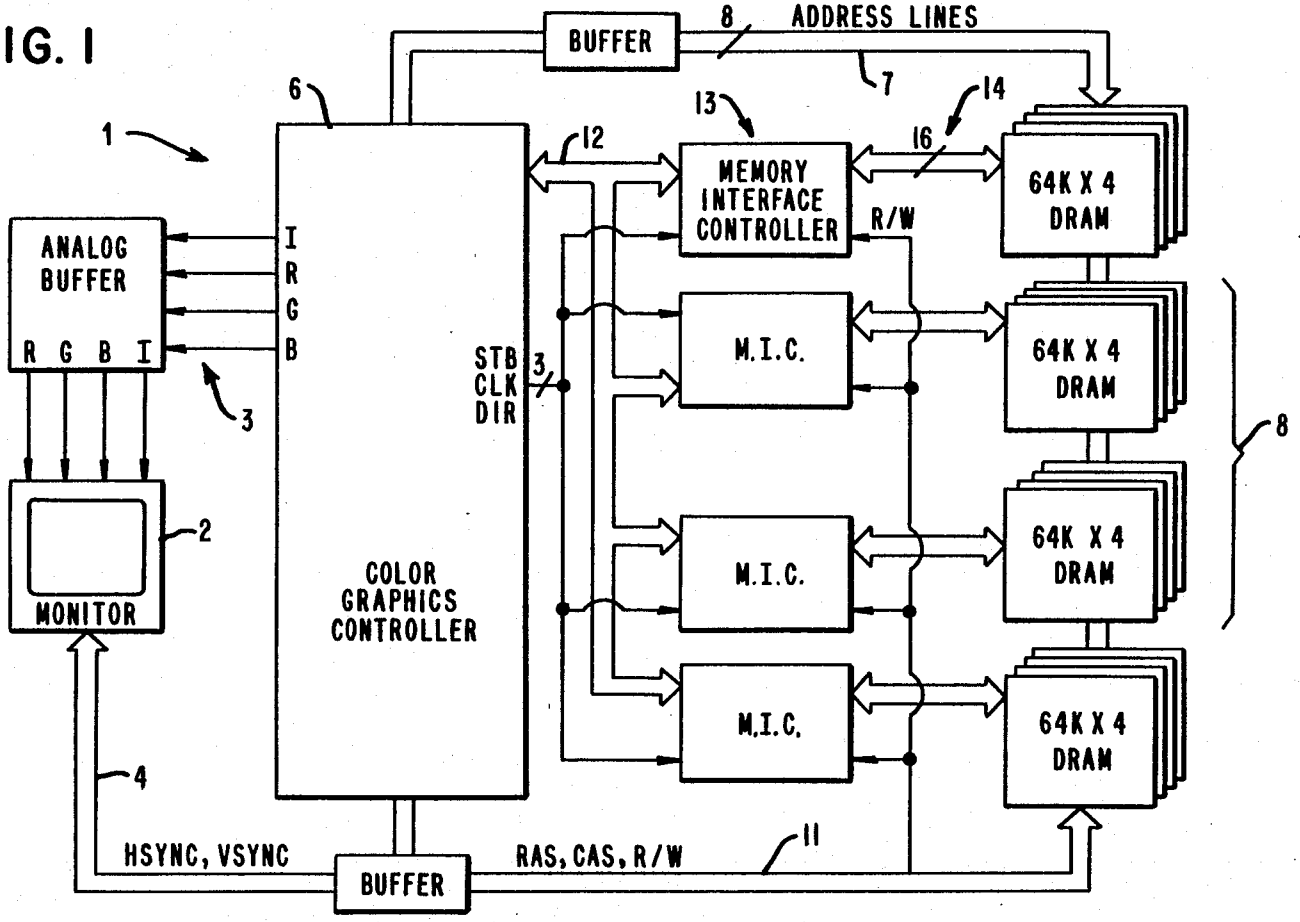
FIG. 1 is a schematic block diagram of a computer color display system according to the present architecture.

Central to the present invention are the structural features which provide, in the context of a color video graphic control system, both a logical drawing mode, based upon logical binary pixel data combinations, and a transparent color operational mode. The architecture by which these features are implemented ensures compatibility with the industry recognized color graphic interface (CGI) standard and the direct graphic interface standard (DGIS) systems. Specific applications of the modes are defined by firmware similar to that utilized in the color graphic and memory interface controllers, the NCR 7300 and 7301 devices, the particulars of which, though providing a useful background, are not essential to the understanding of the present invention. The description of the invention features and their use will be presented in the context of such prior art architecture to assist in the understanding and use of the invention. The ensuing development will begin with generalized description of the functional features and conclude with schematic diagrams illustrating an exemplary circuit embodiment.

Drawing Modes

Generally, the drawing modes provide a means for logically combining pixel data during the creation or modification of images in the frame buffer of a color graphics display system. The logical drawing modes combine the pixel binary data representing the new/source/foreground color with the old/destination/background color in accordance with a pattern defined by a set of mask data. The source, destination and mask data are stored in individual registers. The mask register data is used to align drawing operations to pixel boundaries, to enable operations on single bit planes, and to enable operations on random pixels (as can be used for text drawing operations). As will become apparent upon considering the detailed embodiment, the mask register and associate source and destination register data are handled in groups of two pixel raster elements.

Sixteen logical drawing modes are supported and are listed in Table A.

TABLE A

| Mode # | Logical Operation | X3 | X3 | X1 | X0 |
|---|---|---|---|---|---|
| 0 | D = 0 | 0 | 0 | 0 | 0 |
| 1 | D = D and S | 0 | 0 | 0 | 1 |
| 2 | D = (not D) and S | 0 | 0 | 1 | 0 |
| 3 | D = S | 0 | 0 | 1 | 1 |
| 4 | D = D and (not S) | 0 | 1 | 0 | 0 |
| 5 | D = D | 0 | 1 | 0 | 1 |
| 6 | D = D xor S | 0 | 1 | 1 | 0 |
| 7 | D = D or S | 0 | 1 | 1 | 1 |
| 8 | D = not (D or S) | 1 | 0 | 0 | 0 |
| 9 | D = not (D xor S) | 1 | 0 | 0 | 1 |
| 10 | D = not D | 1 | 0 | 1 | 0 |
| 11 | D = (not D) or S | 1 | 0 | 1 | 1 |
| 12 | D = not S | 1 | 1 | 0 | 0 |
| 13 | D = D or (not S) | 1 | 1 | 0 | 1 |
| 14 | D = not (D and S) | 1 | 1 | 1 | 0 |
| 15 | D = 1 | 1 | 1 | 1 | 1 |

Table A can also be expressed in the form of a truth table as shown in Table B. The values in the Table B correspond to the values set forth by word X0–X3 in Table A. A truth table of the format shown in Table B is defined by the graphics controller when a new drawing mode is selected.

TABLE B

| Source | Dest | Result |
|---|---|---|
| 0 | 0 | X3 |
| 0 | 1 | X2 |
| 1 | 0 | X1 |
| 1 | 1 | X0 |

Once defined, the truth table is latched into the drawing mode register. Preferably, and as embodied herein, more than one truth table is defined such that different logical operations can be executed on different bit planes. This capability is employed when converting compressed or mapped bitmaps (bitmaps which are a single bit per pixel format and which are commonly used for font storage) into multiple plane formats which contain foreground and background colors.

In converting compressed (single bit depth) bitmaps or pixels to full depth (number of bits per pixel supported in the system or as desired for the application), the format where a 0 compressed value selects the background color and a 1 value selects the foreground color is commonly used. Referring to the truth table (Table B) which describes the 16 logical operations, a new table (Table C) is defined for use when converting mapped bitmaps to bitmaps of greater pixel depth. This table illustrates the truth tables that would be used for each bit plane, depending on foreground and background color bit values for those planes.

TABLE C

| Foreground Color | Background Color | Truth Table D | 0 | 1 |
|---|---|---|---|---|
| | | S | | |
| 0 | 0 | 0 | X3 | X2 |
| | | 1 | X3 | X2 |
| 0 | 1 | 0 | X1 | X0 |
| | | 1 | X3 | X2 |
| 1 | 0 | 0 | X3 | X2 |
| | | 1 | X1 | X0 |
| 1 | 1 | 0 | X1 | X0 |

TABLE C-continued

| Foreground Color | Background Color | Truth Table D | 0 | 1 |
|---|---|---|---|---|
| | | 1 | X1 | X0 |

This truth table can also be expressed in the following form:

| | Destination 0 | 1 |
|---|---|---|
| Source 0 | A | B |
| 1 | C | D |

If BG = 0 then A = X3; B = X2
If BG = 1 then A = X1; B = X0
If FG = 0 then C = X3; D = X2
If FG = 1 then C = X1; D = X0
Where BG = Background Color
and FG = Foreground Color The method described through Table C permits logical drawing operations to be performed using mapped or compressed source bitmap data without first converting the source bit to the foregound or background color and then implementing logic operations as described in Tables A and B. This architecture results in simplified logic and faster execution.

Transparency Mode

The transparency mode is implemented by latching the eight bit data word representing the transparency color into a register, and then comparing by individual pixel the source color data with the defined transparency color. For most applications, if the source/new/-foreground color and transparency color data match for a pixel position, the data in the destination/background register remains unchanged. The absence of such a match results in the source color data being transferred into the corresponding pixel position of the destination color register. Other responses based upon a match are described in Table D.

As preferably embodied, a pixel data bus composed of sixteen lines is used to simultaneously transfer for comparison the data representing two adjacent pixel positions. The embodying transparency mode further includes the ability to refine the transparency logic operation by using two opcode control bits in the sequence of Table D, below, to interject the defined logic functions into the comparison operation.

TABLE D

| Opcode Bits TFL1 | Opcode Bits TFL0 | Logic Functions |
|---|---|---|
| 0 | 0 | Transparency disabled |
| 0 | 1 | No change to destination pixels if source matches transparent color - foreground shows if no match occurs. |
| 1 | 0 | Only change destination pixels if source matches transparent color - background shows if match occurs. |
| 1 | 1 | Illegal |

Preferably the transparency color is also subject to an access mask, in this case a mask operable by bit plane. As such, the transparency color data for disabled planes will be subject to a "don't care" condition in determining whether a match exists. This is analogous to the first opcode condition depicted in Table D.

EXAMPLE

With the functional features at hand, attention is now directed to the drawings for a detailed consideration of an embodying system structure. FIG. 1 schematically illustrates, by block diagram, a computer architecture 1 in which the invention controls the color graphic signals driving the video display monitor 2. Monitor 2 responds to buffered intensity/red/green/blue (IRGB) signals furnished on lines 3 as well as the buffered vertical and horizontal synchronization signals furnished on line 4, all originating in color graphics controller 6. As was noted earlier, controller 6 is very similar in material respects to the commercially marketed NCR 7300 device, any distinctions of substance identified hereinafter.

One set of outputs from controller 6 are the buffered memory array address lines on bus 7 to dynamic random access memory (DRAM) array 8. As embodied in the illustration, memory array 8 is composed of sixteen 64K×4 DRAM devices together forming a 512 pixel frame buffer. Controller 6 also generates the conventional row address strobe (RAS) and the column address strobe (CAS) signals, together with the read/-write (R/W) signals which define whether the 512 pixel memory array 8 is being read or written during addressing. The characteristics of the RAS, CAS and R/W signals on bus 11 are well known. Controller 6 furnishes as additional output signals a timing/synchronization strobe signal (STB) to control transfers of data on pixel bus 12, a direction control signal (DIR) to define the transmission direction of the signals on pixel bus 12, and a master clock signal (CLK).

The R/W, STB, CLK and DIR signals together with pixel bus 12 are furnished to each of four memory interface controllers 13. The memory interface controllers 13 are joined by sixteen line buses 14 to frame buffer memory array 8.

Figure 2A:
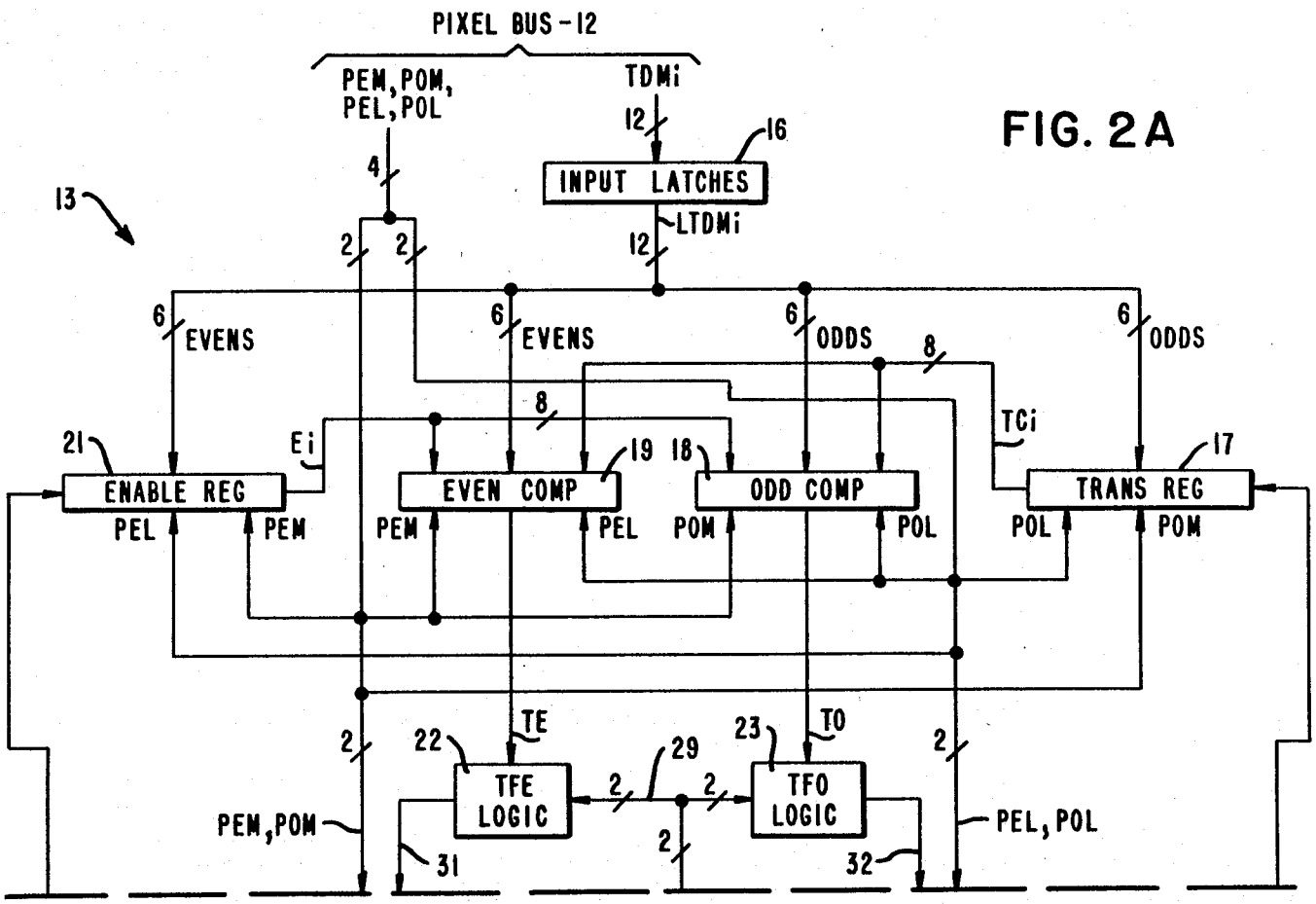
FIGS. 2A and 2B together schematically depict in block diagram form the architecture for implementing the transparency and logical drawing mode functions in the context of a known graphics controller system.
Figure 2B:
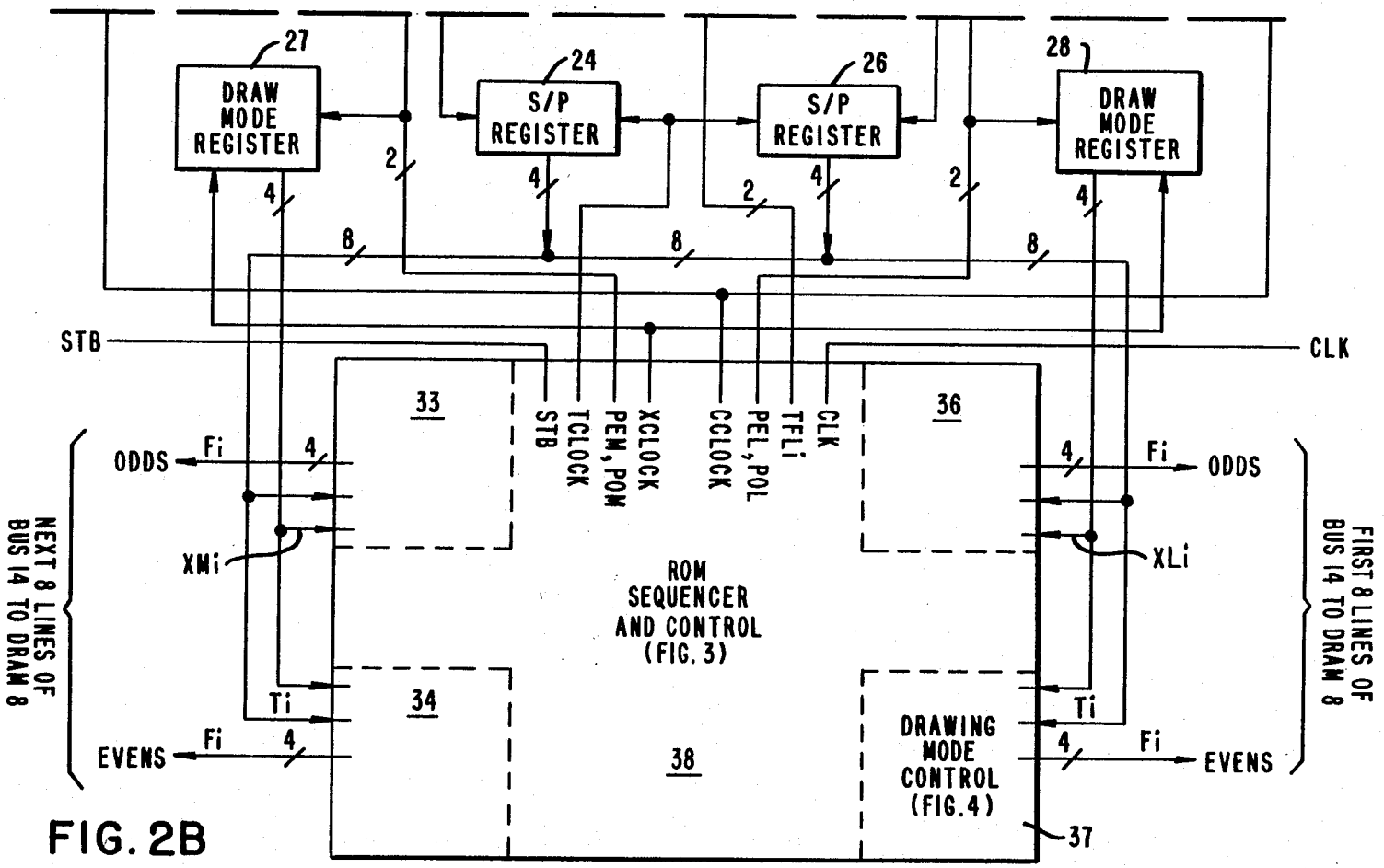

The transparency and logical drawing modes are fundamentally generated in the four memory interface controller blocks 13, the internal functions and connections of the block being depicted in the composite of FIGS. 2A and 2B. Directing attention to FIG. 2A, sixteen line wide pixel bus 12 includes four multiple use lines, control and data lines PEM, POM, PEL and POL, as well as twelve dedicated data lines identified as TDM0–TDMll. Pixel data transfers use all sixteen lines of bus 12 to simultaneously pass eight bit words for each of two pixels.

The transparency and drawing mode data TDMi are converted to latched form signals LTDMi by input latches 16. Transparency register 17 latches the eight bit wide words corresponding to the specified transparency color, receiving those words from pixel bus 12 over the combination of eight lines including POL, POM, and the odd numbered of the latched data lines LTDM0–LTDMll. As an output, transparency register 17 provides an eight bit wide word TC0–TC7 to both odd comparator 18 and even comparator 19.

Binary data representing the enable mask, which as noted earlier establishes a "don't care" condition by plane for the transparency color evaluation, are furnished on the combination of the lines PEL, PEM and the six even numbered of the latched data lines LTDMi. The eight bit wide enable word latched into enable register 21 is thereafter provided as an output on lines E0–E7 to both even comparator 19 and odd comparator 18. Note that the allocation of lines from pixel bus 12 to transparency register 17 and enable register 21 permits the simultaneous transmission and latching of transparency and enable words. Thereafter, odd comparator 18 and even comparator 19 individually and simultaneously receive eight bit words of data representing the color of the source pixel, for comparison against the latched transparency color in the context of the enable data.

Incoming source pixel color data is compared to the transparency color data word TCi in each of comparators 18 and 19. The presence of a match in odd comparator 18 is designated by a TO signal, while a match in even comparator 19 is designated by a TE signal. When the source pixel data word matches the specified transparency color, as modified, the destination pixel color data word is to be transmitted for display.

Enable register 21 provides an eight bit mask word to each of the comparators 18 and 19. The enable register word modifies the color comparison by selectively ignoring bit by plane of the transparency color for purposes of determining a match. For example, the enable register word could define that the comparisons involve only six of the eight bits in a word, effectively reducing the match criteria by ignoring any mismatch in the remaining two bit planes.

The particular arrangement of the elements in FIG. 2A simultaneously evaluates the color of two pixel positions, distinguished by even and odd nomenclature, from a composite of two eight bit words simultaneously conveyed on the sixteen lines of pixel bus 12. The odd-/even concept and concurrent processing of two pixel positions of video color data is continued through transparency flag logic blocks 22 and 23, respectively providing even and odd logic responsive to transparency matches, and further into serial-to-parallel shift registers 24 and 26 together with corresponding drawing mode registers 27 and 28 in FIG. 2B. The concurrent processing of two pixels increases the effective operating speed of the system.

An enable masked transparency color match in the even pixel position, indicated by a signal TE, is conveyed as an input to transparency flag even (TFE) logic block 22. A similar evaluation for the odd pixel position is connected to TFO logic block 23. The even and odd logic blocks provide flag signals on their respective output lines 31 and 32 to corresponding clocked shift registers 24 and 26. The states of the even and odd transparency are also influenced by two opcode control signals TFL0 and TFLl on lines 29 according to the logic defined in Table D, hereinbefore. For example, if TFL0 and TFLl are both zero the transparency function is disabled and the destination/background color previously in the memory array is changed to the newly defined source/ foreground color. If, on the other hand, the transparency flags set are at 0 and 1, respectively, for TFL0 and TFLl, the color stored in the memory array for that pixel position, even and odd individually, is changed to the foreground color only if a match is detected. Recall that a match can be defined as a complete correspondence of eight bits, or fewer than eight bits by the action of the enable register.

Directing attention to FIG. 2B, the respective even and odd transparency flag signals are transferred from serial-to-parallel shift registers 24 and 26 in parallel on eight lines T0–T7 to respective drawing mode control blocks 33, 34, 36 and 37. Drawing mode logic block 33 and 34, as well as 36 and 37, are paired to receive both the even and odd segments of the data for the corresponding pixel position. Drawing mode control blocks 33 and 34 provide as outputs a composite eight bit word representing the color data for a pixel position, while blocks 36 and 37 provide corresponding output signals representing the color of the adjacent pixel in the frame buffer. In the context of the system depicted in FIG. 1 with four memory interface controllers 13, frame buffer memory array 8 is periodically updated by the simultaneous transmission of color data words for groups of eight pixels.

Figure 4:
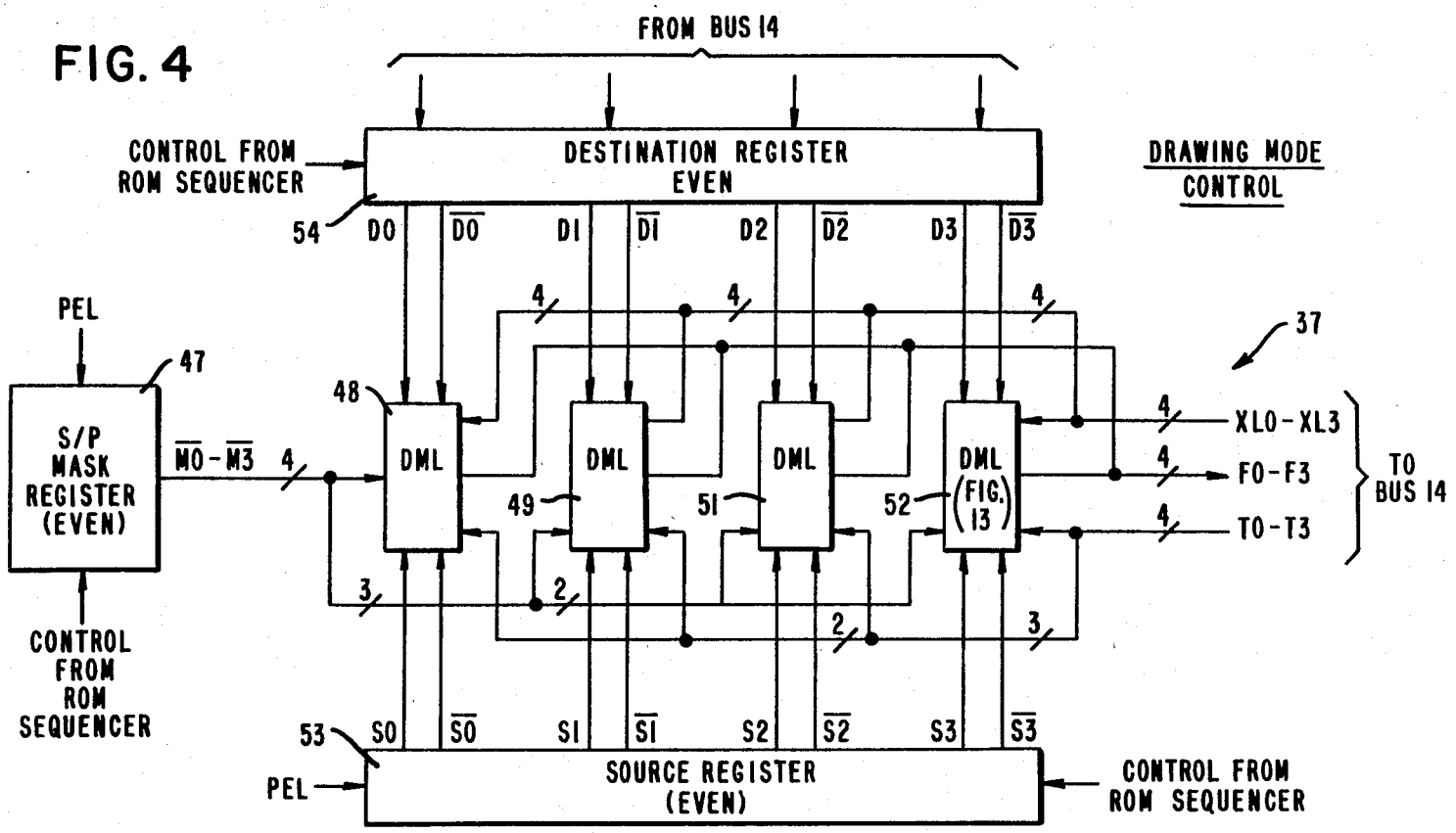
FIG. 4 is a schematic block diagram for implementing the mask feature of the logical drawing mode as an element of the block diagram in FIG. 2B.

The logical drawing mode is implemented in accordance with the control signals latched into drawing mode registers 27 and 28, shown in FIG. 2B. Drawing register 27 receives, and shifts in for purposes of latching, signals on lines PEM and POM to provide a simultaneous set of four outputs XM0–XM3 to drawing mode controls 33 and 34. A similar operation is performed by drawing mode register 28, here receiving and latching signals from lines PEL and POL to provide outputs XL0–XL3 to associated drawing mode control blocks 36 and 37. The elements internal to representative drawing mode control block 37 are depicted in FIG. 4.

ROM sequencer and control 38 in FIG. 2B receives as inputs the strobe signal STB, the master clock signal CLK, together with the control signals on lines PEM, POM, PEL and POL, and generates as outputs the clock synchronized signals CCLOCK, XCLOCK, TCLOCK and the TFLi signals. The functional elements in ROM sequencer and control 38 which pertain to the present invention are schematically depicted in FIG. 3.

Figure 3:
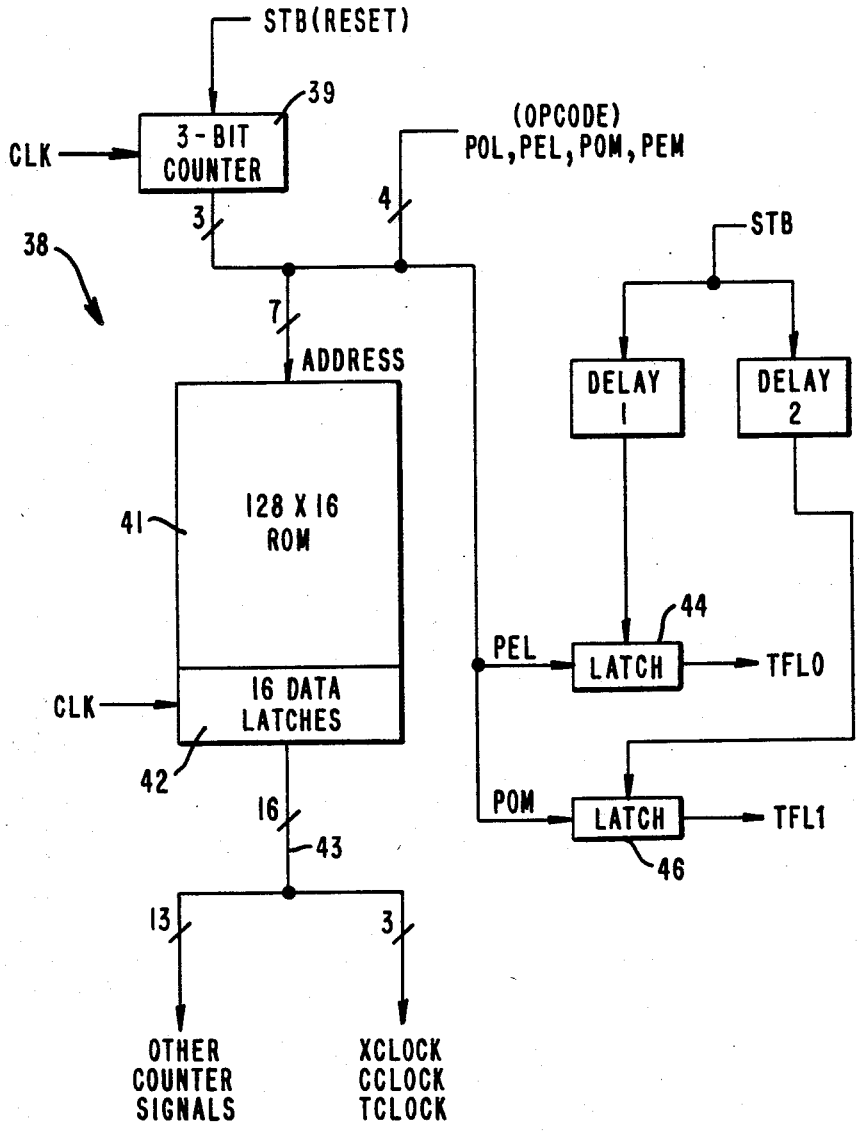
FIG. 3 is a schematic block diagram of the ROM sequencer and control in FIG. 2B.

As shown in FIG. 3, ROM sequencer and control 38 is comprised of a three bit counter 39 toggled by the master clock signal CLK and reset by the master strobe signal STB. The three bits of the counter are combined with the opcode signals on lines POL, PEL, POM and PEM to serve as addresses to 128×16 ROM 41. The output control signals defined by ROM 41 are latched in synchronism with the CLK signal into latch 42 and provided as outputs onto bus 43. The XCLOCK signal latches the drawing mode values on lines PEL, POL, PEM and POM into the respective drawing mode registers 27 and 28 (FIG. 2B). The CCLOCK signal latches the transparency color and enable data into respective registers 21 and 17 (FIG. 2A). The TCLOCK signal shifts the outputs from transparency flag logic blocks 22 and 23 (FIG. 2A) into respective serial-to-parallel shift registers 24 and 26 (FIG. 2B). The remaining 13 lines from latches 42 are control signals which either do not materially pertain to the present invention or are elements of the prior configurations associated with the aforementioned commercial products.

ROM sequencer and control 38 in FIG. 3 also includes latches 44 and 46 for holding opcode signals from lines PEL and POM of pixel bus 12 (FIG. 2A) as the TFL0 and TFL1 signals furnished to TFE and TFO logic blocks 22 and 23. The latches 44 and 46 are enabled by the strobe signal STB following incrementally different delay intervals.

The drawing modes are logic functions used to combine source/foreground and destination/ background pixels when creating or modifying images in the frame buffer memory of the video display system. A destination register normally contains the background pixel data, while the source register contains the new color data for the pixel. The mask register is used to align the drawing operation to a pixel boundary by plane.

The functional elements which make up each of the drawing mode controls 33, 34, 36 and 37 in FIG. 2B are particularized in FIG. 4 and corresponding examplary truth Table B. The four bit word which specifies the drawing mode in the DGIS convention defines the truth table and controls the logical evaluations performed in drawing mode control blocks 33, 34, 36 and 37. The drawing mode can be defined differently for each bit plane, or the same for all bit planes, in keeping with the DGIS standard.

The outputs from drawing mode controls 36 and 37, as embodied in FIG. 2B, are eight bits F0–F7, which represent by bit pairs data for four pixels. At the left of FIG. 2B, the eight bits F8–F15 provide as outputs additional pairs of bits for the same set of four pixels. Recall that the use of four separate sixteen bit buses 14 for the present embodiment (FIG. 1) coincides with the choice of the processing two pixels simultaneously.

The elements within a representative drawing mode control block, e.g. 37 in FIG. 2B, are depicted in FIG. 4. The features which distinguish drawing mode control blocks 33, 34 and 36 will become immediately apparent upon considering the arrangement of elements within block 37. Directing attention to FIG. 4, serial-to-parallel mask register 47 latches the mask signals as they successively appear on line PEL, and thereafter provides a latched mask data word M0–M3 to each of drawing mode logic blocks 48, 49, 51 and 52. Source register 53 is loaded off line PEL with a different set of four bits, representing the source/foreground color. The latched source data bits and their complements are thereafter provided as signals S0–S3 to each of the respective drawing mode logic blocks 48, 49, 51 and 52. The background/destination data is multiplexed off memory array bus 14 (FIG. 1) and latched into destination register 54. The four bits representing the background color are with their complements also connected to drawing mode logic blocks 48, 49, 51 and 52. Clocking of data into registers 47 and 53 off the PEL line, and into register 54 from bus 14 is accomplished by control signals generated in ROM sequencer and control 38 (FIG. 3) in keeping with the practice of the prior art. Drawing mode logic blocks 48, 49, 51 and 52 also receive respectively XL0–XL3 and T0–T3 signals as inputs, where the XL0–XL3 signals originate in drawing mode register 28 while signals T0–T3 originate in serial-to-parallel register 26 as first depicted in FIG. 2B.

The four individual outputs from drawing mode logic blocks 48, 49, 51 and 52, namely F0–F3, are multiplexed onto bus 14 to DRAM memory array 8 (FIGS. 1 and 2B). The multiplexing of signals to and from the DRAM elements in the memory array coincide with commonly understood read/write operations in memory systems.

Functional devices suitable to implement the unique operations defined by blocks in FIGS. 1–4 are shown with more particularity in the succession of FIGS. 5–13.

Figure 5:
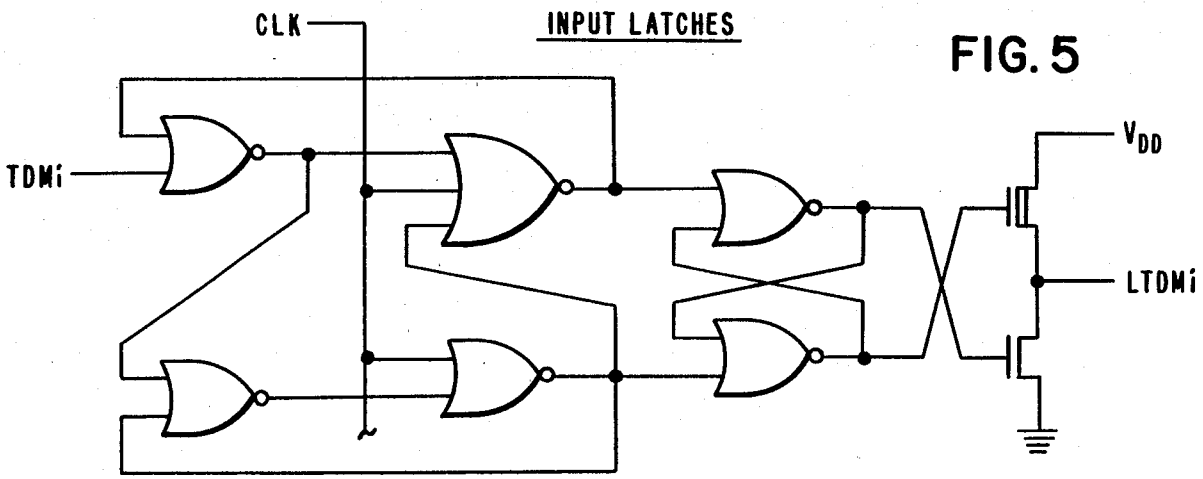
FIGS. 5–12 schematically illustrate the structures and interconnections of logic circuit elements suitable to perform the functions set forth by block diagram in FIGS. 2A and 2B.
Figure 10:
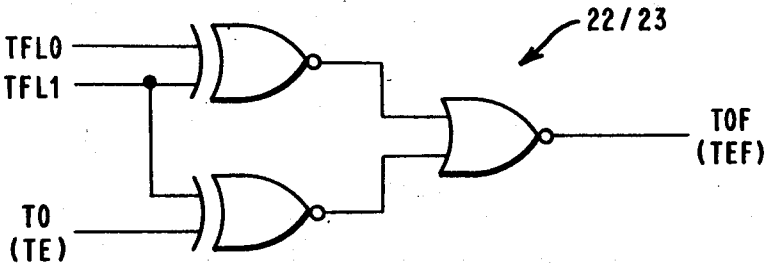
Figure 6:
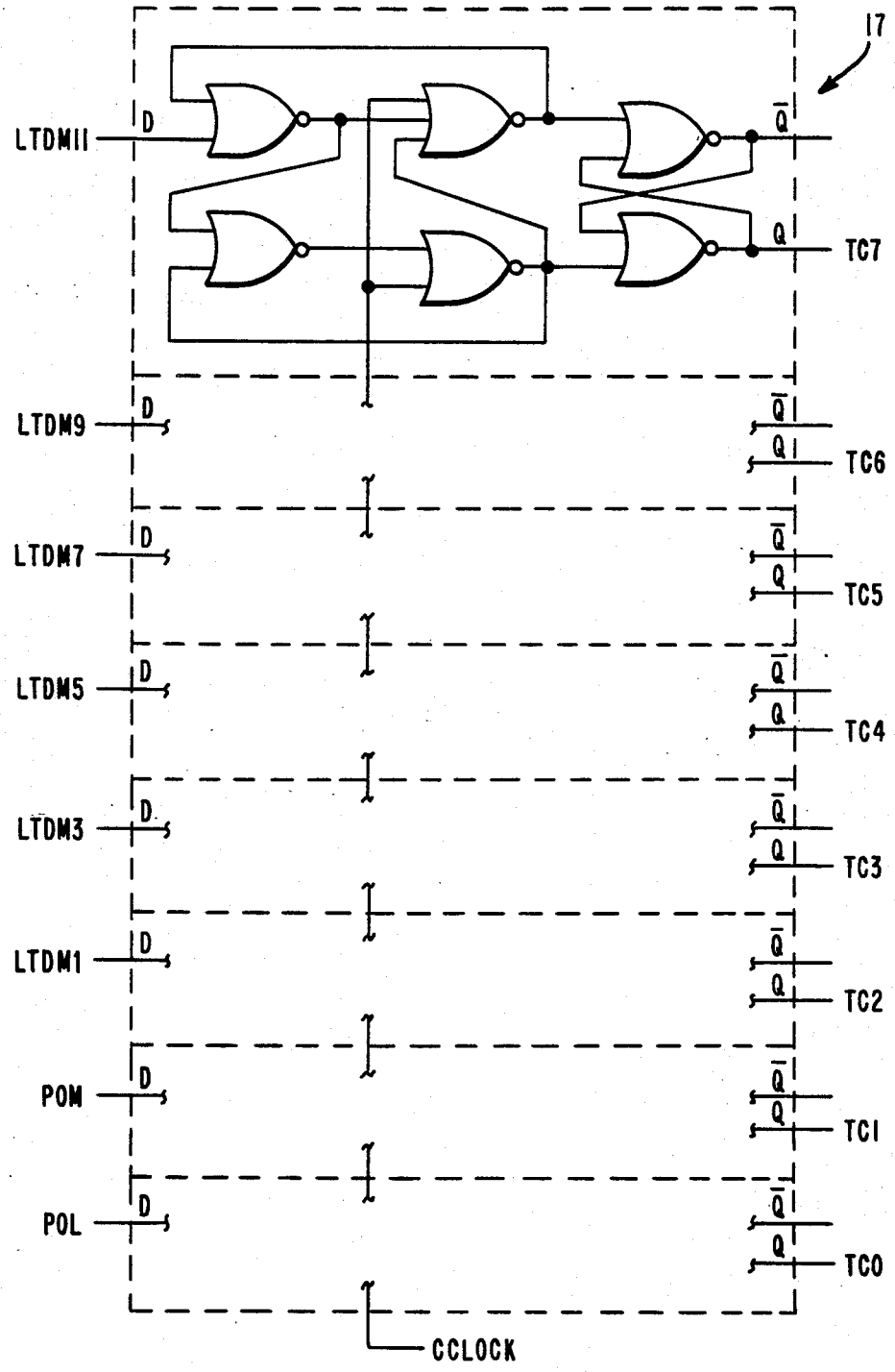
Figure 7:
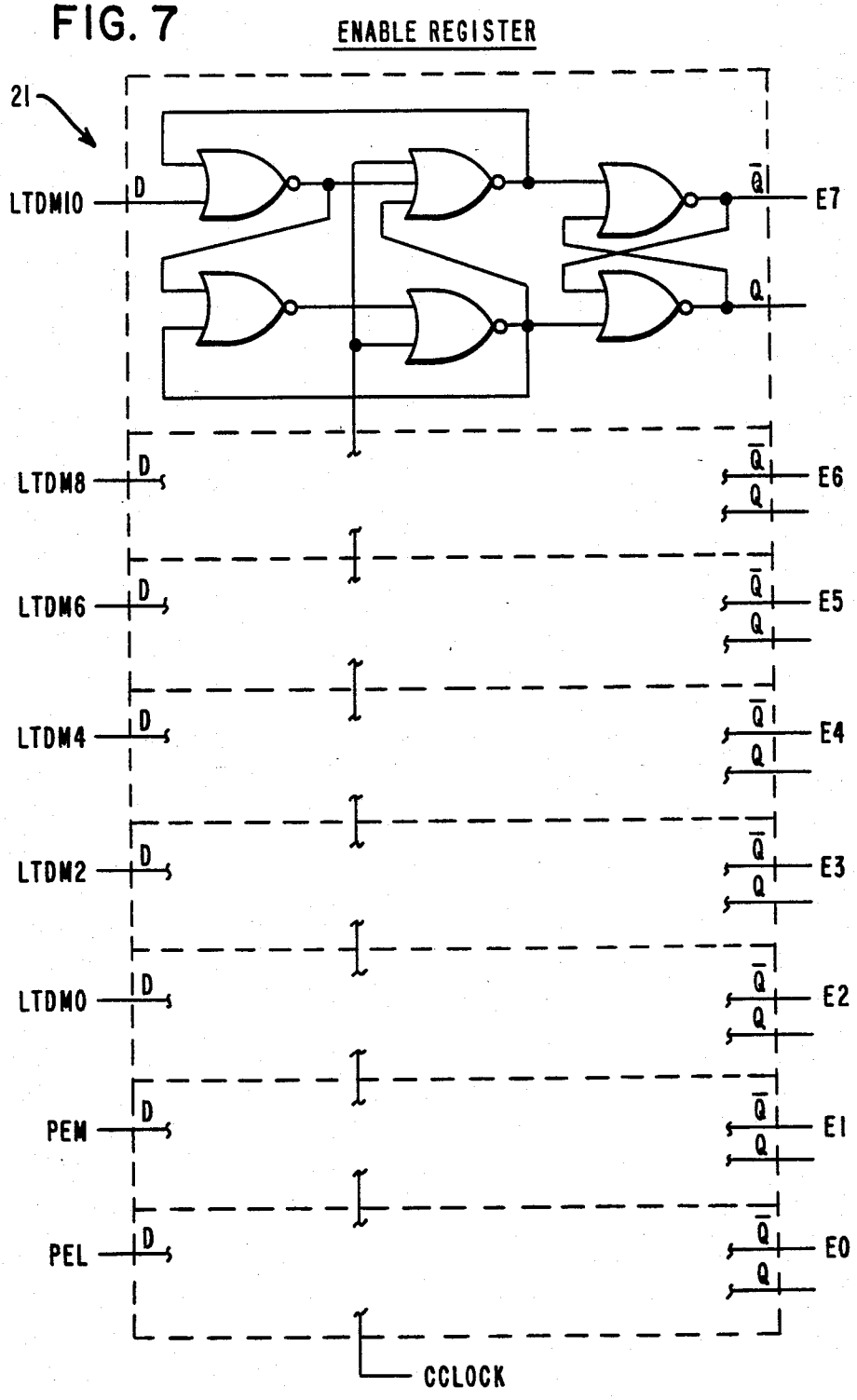
Figure 8:
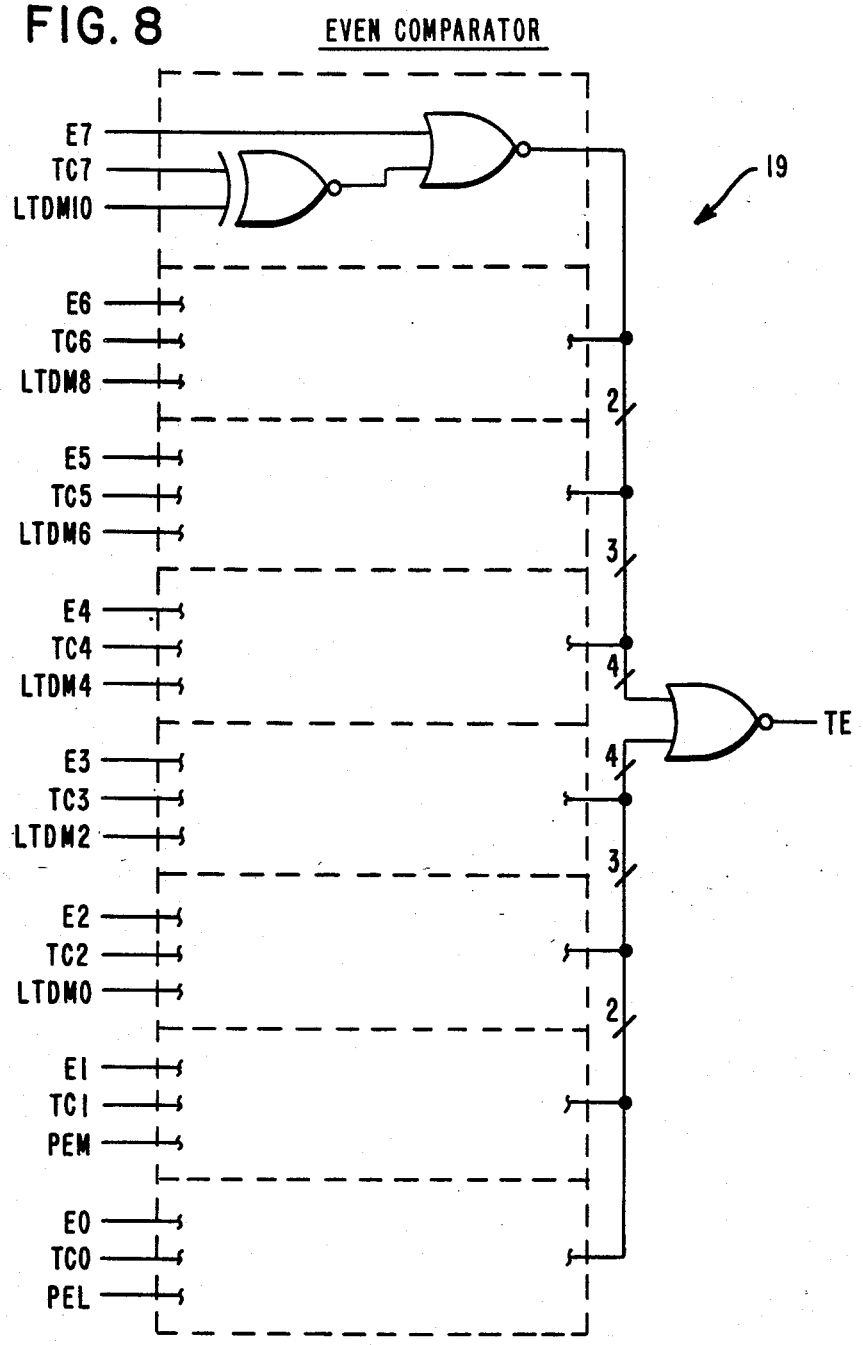
Figure 9:
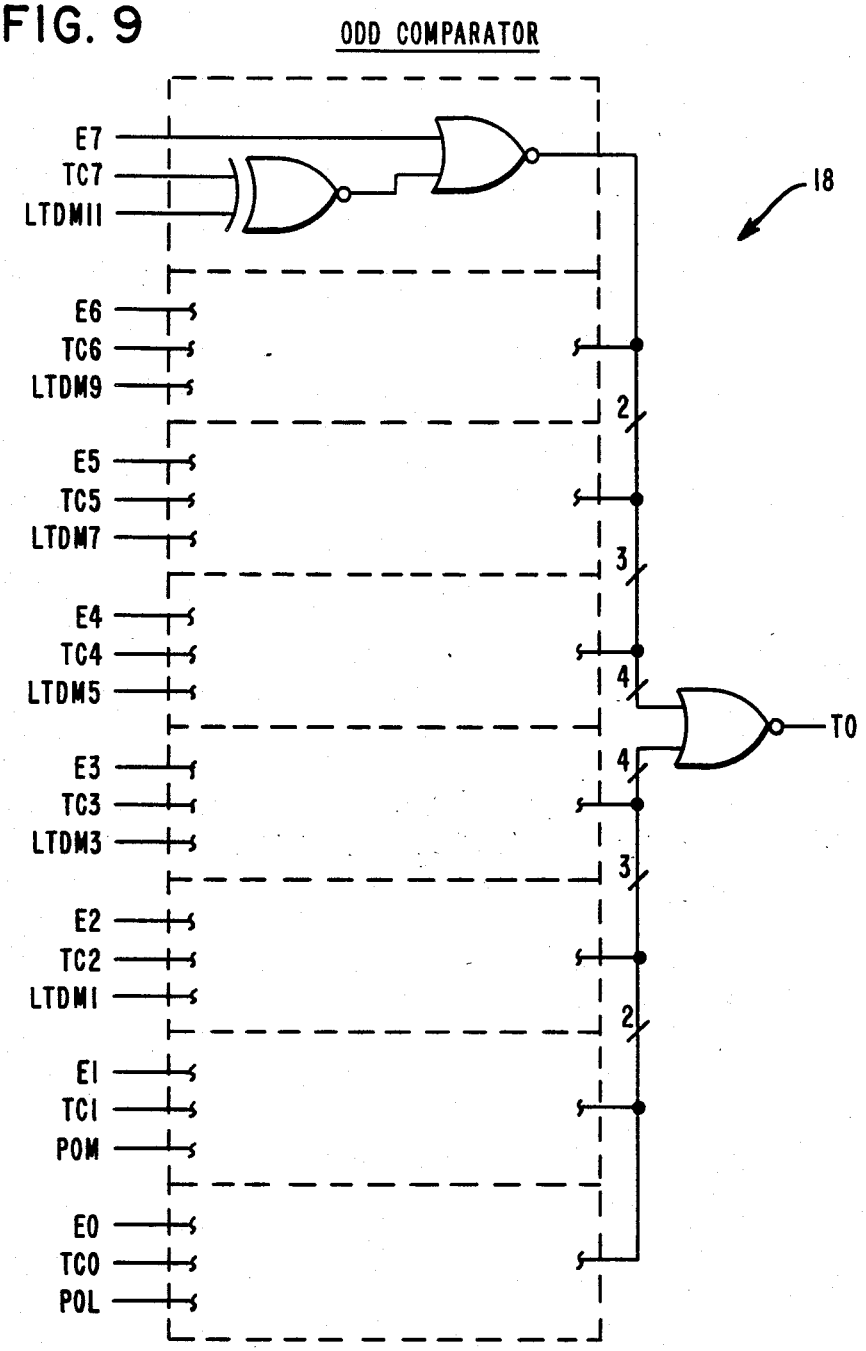
Figure 11:
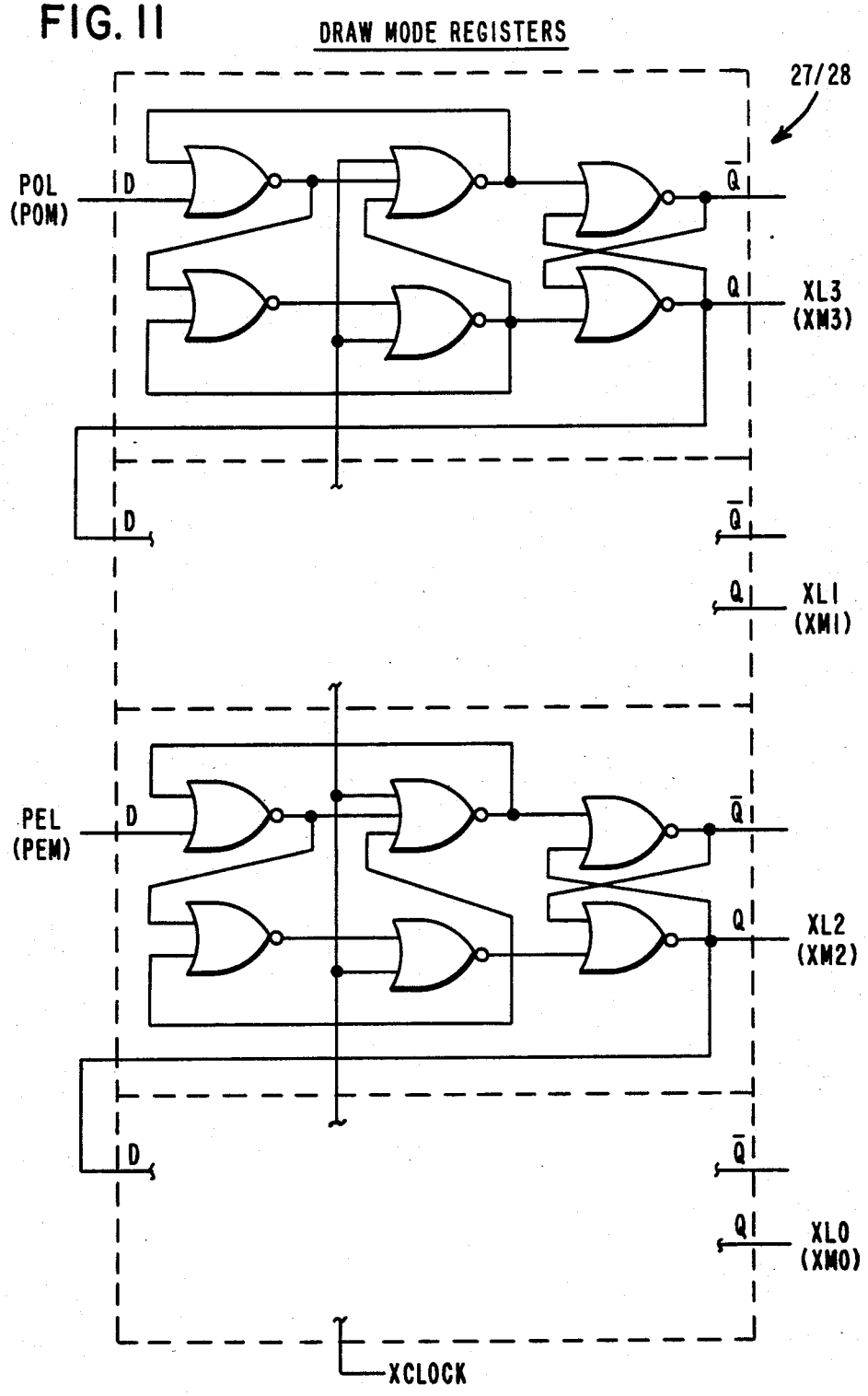
Figure 12:
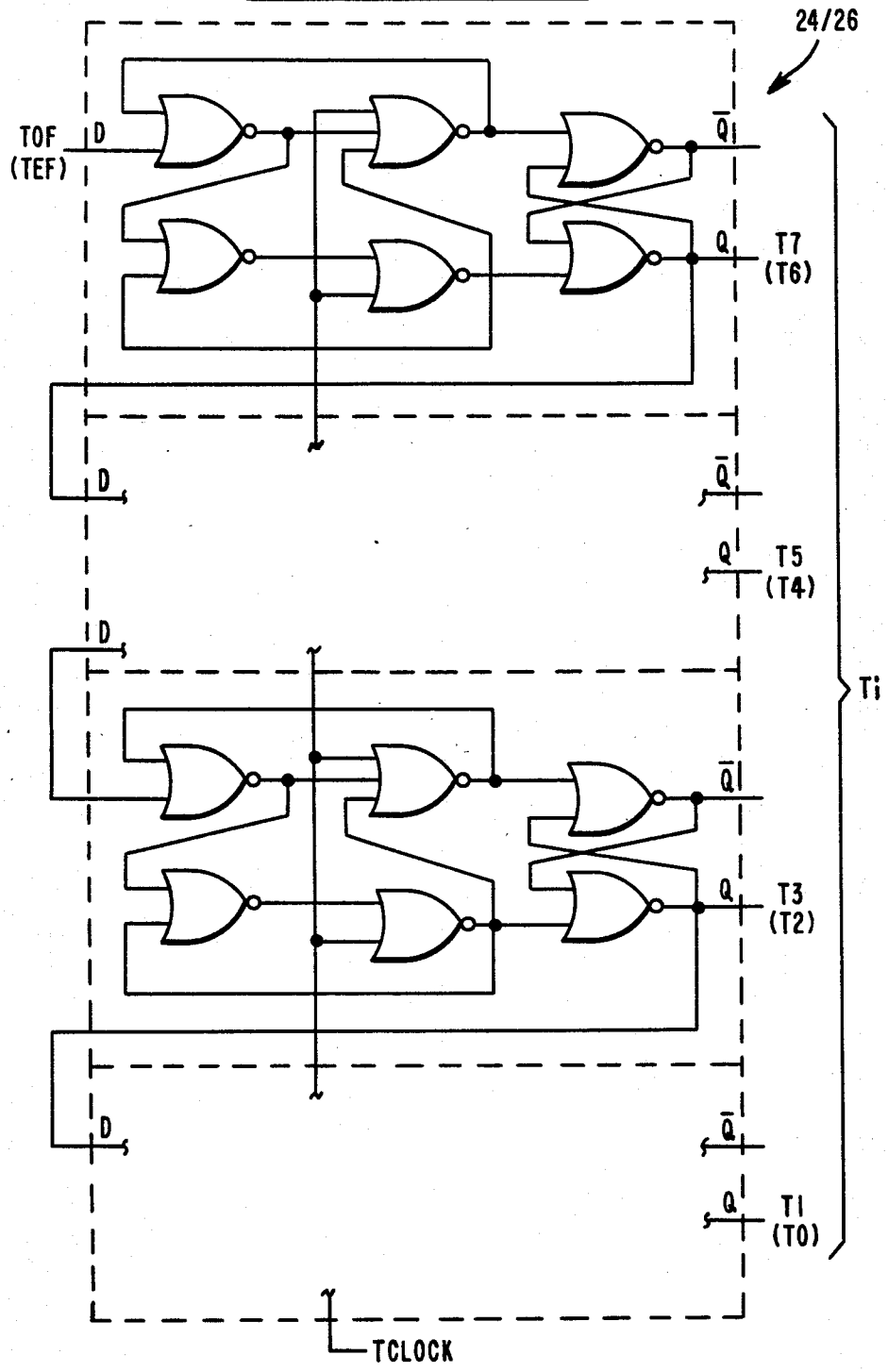

FIG. 5 schematically illustrates an element suitable to latch one line of data for clocked input latch 16 in FIG. 2A. FIG. 6 schematically illustrates the logic elements which comprise the transparent color register 17 in FIG. 2A. Similarly, enable register 21 in FIG. 2A is shown by way of individual logic elements in FIG. 7. The elements internal to even comparator 19 and odd comparator 18 are individually illustrated in respective FIGS. 8 and 9 of the drawings. The TFE and TFO logic blocks 22 and 23 originally appearing in FIG. 2A are shown by detailed representation in FIG. 10.

The logic devices which make up the blocks in FIG. 2B were partially particularlized in the description directed to FIGS. 3 and 4. Of the remaining blocks in FIG. 2B, drawing mode registers 27 and 28 are illustrated by detailed logic elements in FIG. 11. The serial-to-parallel shift register blocks 24 and 26 are detailed in FIG. 12.

Figure 13:
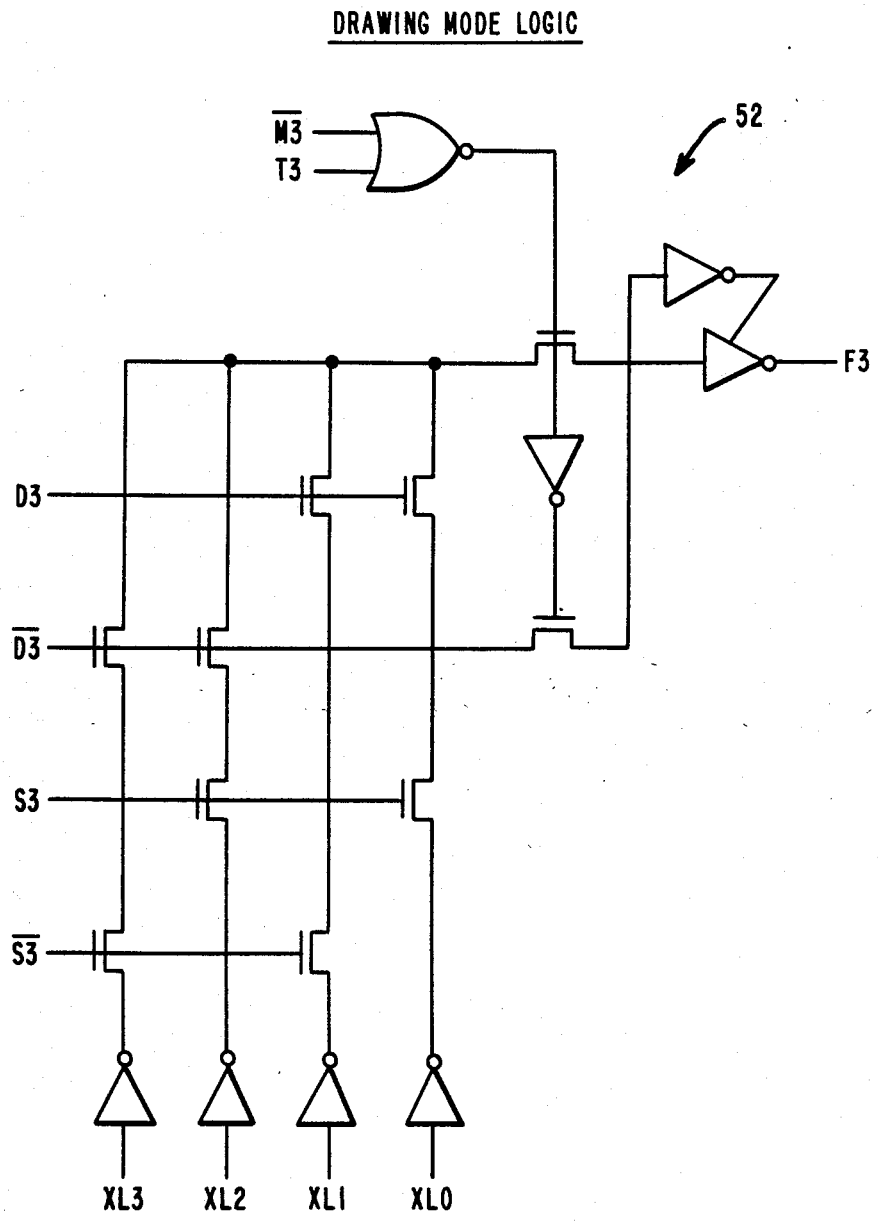
FIG. 13 is a circuit schematically illustrating one embodiment of the logic drawing mode block functionally depicted in FIG. 4.

The internal structure of drawing mode logic blocks 48, 49, 1 and 52, first identified in FIG. 4, is schematically illustrated in FIG. 13 of the drawings. As suggested by the reference number, the embodiment in FIG. 13 corresponds to block 52 in FIG. 4, which itself is situated within block 37 in FIG. 2B. The counterparts of FIG. 4 with respect to functions defined in FIG. 2B are similarly configured excepting that for blocks 33 and 34 in FIG. 2B the inputs would be XM0–XM4 in place of XL0–XL3.

Given the relatively advanced level of skill and understanding of those routinely designing logic circuits, individualized analysis of the operations performed by the various logic gates in FIGS. 5–13 is believed to be superfluous.

Though the invention has been shown and described by way of a specific embodiment, the claims should be accorded and interpretation consist with scope of the novel and nonobvious features disclosed.

We claim:

1. Apparatus for implementing a read-modify-write sequence in a pixel based video graphics controller using a frame buffer, comprising:

a source of binary data representing transparency color for a pixel;

a source of binary data representing foreground color for the pixel;

binary data representing background color for the pixel sourced from the frame buffer;

means for comparing by pixel foreground color data with transparency color data and generating a signal upon correspondence; and means for transmitting either the foreground color binary data or the background color binary data to the frame buffer in response to said logically defined signal from the means for comparing.

2. the apparatus recited in claim 1, further including:

a source of binary data representing a selected group of logical combinations of pixel foreground color binary data and pixel background color binary data; and means for logically combining the binary data representing select logical combinations with data representing the signal upon correspondence and generating an output signal upon a selective combination.

3. The apparatus recited in claim 2, further including:

a source of binary data representing a logic mask of pixel color binary data;

means responsive to the binary data representing the logic mask for further logically combining the logic mask pixel color binary data with the pixel foreground color binary data, the pixel background color binary data, and the signal upon correspondence to generate output signal representing a logical combination of the data.

4. The apparatus recited in claim 1, further including:

a source of binary data representing a transparency mask applied to the transparency color data; and means responsive to the binary data representing the transparency mask for disabling the effects of select bits of the transparency color binary data in the means for comparing.

5. The apparatus recited in claim 4, wherein:

the means for comparing by pixel evaluates the foreground and the transparency binary color data by individual bit for a match condition; and the means responsive to the binary data representing the transparency mask defines "don't care" conditions for selected bits undergoing evaluation in the means for comparing.

6. The apparatus recited in claim 4, further including:

a source of binary data representing a selected group of logical combinations of pixel foreground color binary data and pixel background color binary data; and means for logically combining the binary data representing select logical combinations with data representing the signal upon correspondence and generating an output signal upon a selective combination.

7. The apparatus recited in claim 6, further including:

a source of binary data representing a logic mask of pixel color binary data;

means responsive to the binary data representing the logic mask for further logically combining the logic mask pixel color binary data with the pixel foreground color binary data, the pixel background color binary data, and the signal upon correspondence to generate output signal representing a logical combination of the data.

8. The apparatus recited in claim 7, wherein:

the means for comparing by pixel evaluates the foreground and the transparency binary color data by individual bit for a match condition; and the means responsive to the binary data representing the transparency mask defines "don't care" conditions for selected bits undergoing evaluation in the means for comparing.

* * * * *

UNITED STATES PATENT AND TRADEMARK OFFICE

CERTIFICATE OF CORRECTION

PATENT NO. : 4,893,116

DATED : January 9, 1990

INVENTOR(S) : David L. Henderson et al.

It is certified that error appears in the above-identified patent and that said Letters Patent is hereby corrected as shown below:

Column 9, line 42, after the word "data", insert --on a bit by bit basis--.

Column 9, line 42, after the words "generating a", insert --logically defined--.

Column 9, line 42, and 43 after the word "signal", insert --based--.

Column 9, line 43, after the word "upon", insert --a one-to-one--.

Signed and Sealed this

Twenty-second Day of January, 1991

*Attest:*

HARRY F. MANBECK, JR.

*Attesting Officer*

*Commissioner of Patents and Trademarks*